US010443458B2

(12) United States Patent
Morton et al.

(10) Patent No.: US 10,443,458 B2
(45) Date of Patent: Oct. 15, 2019

(54) ENGINE ASSEMBLY WITH PASSAGEWAY FOR REDUCING OIL LEAKAGE

(71) Applicant: Ford Global Technologies, LLC, Dearborn, MI (US)

(72) Inventors: Scott Morton, New Boston, MI (US); Claude Weston Bailey, III, Warren, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 844 days.

(21) Appl. No.: 14/277,103

(22) Filed: May 14, 2014

(65) Prior Publication Data

US 2015/0330327 A1 Nov. 19, 2015

(51) Int. Cl.

| | |
|---|---|
| ***F02F 1/42*** | (2006.01) |
| ***F01M 11/00*** | (2006.01) |
| ***F02F 1/24*** | (2006.01) |
| ***F02F 7/00*** | (2006.01) |
| ***F02F 11/00*** | (2006.01) |

(52) U.S. Cl.

CPC ..... *F01M 11/00* (2013.01); *F02F 1/24* (2013.01); *F02F 7/006* (2013.01); *F02F 11/002* (2013.01); *Y10T 29/49272* (2015.01)

(58) Field of Classification Search

CPC .. F16J 15/004; F16J 2015/0868; F16J 15/008; F16J 15/0818; F16J 15/0825; F16J 15/104; F16J 15/3448; F16J 2015/0856

USPC ..... 123/193.5

See application file for complete search history.

(56) References Cited

U.S. PATENT DOCUMENTS

| | | | | |
|---|---|---|---|---|
| 2,771,870 | A | 11/1956 | Hutchison | |
| 3,352,564 | A * | 11/1967 | Johnson | F16J 15/123 277/593 |
| 4,384,557 | A | 5/1983 | Johnson | |
| 4,584,975 | A * | 4/1986 | Ohmi | F01M 9/10 123/193.5 |
| 4,894,636 | A * | 1/1990 | Sugibuchi et al. | 338/9 |
| 4,900,039 | A | 2/1990 | Klecker et al. | |
| 4,993,375 | A * | 2/1991 | Akihiko | F01M 13/0416 123/195 C |
| 6,293,245 | B1 | 9/2001 | Bock | |
| 6,491,014 | B1 * | 12/2002 | Eickert | F02B 75/22 123/195 C |
| 7,117,858 | B2 * | 10/2006 | Nonaka et al. | 123/572 |
| 7,152,571 | B1 | 12/2006 | Wilson et al. | |
| 7,343,890 | B1 * | 3/2008 | Platt | F02F 7/006 123/195 C |
| 8,347,865 | B2 * | 1/2013 | Valencia et al. | 123/574 |

(Continued)

FOREIGN PATENT DOCUMENTS

| | | |
|---|---|---|
| CN | 201531594 U | 7/2010 |
| CN | 103775166 A | 5/2014 |
| JP | 2010071301 A | 4/2010 |

*Primary Examiner* — Marguerite J McMahon
*Assistant Examiner* — James J Kim
(74) *Attorney, Agent, or Firm* — LeClairRyan

(57) ABSTRACT

In one aspect, the present invention provides an engine assembly, which includes at least one cylinder head including a first surface, and at least one camshaft cover including a second surface, the first and second surfaces together defining a passageway positioned next to a seal for reducing oil leakage. The passageway may be defined by a recess on at least one of the first and second surfaces.

20 Claims, 4 Drawing Sheets

(56) References Cited

U.S. PATENT DOCUMENTS

| | | | | |
|---|---|---|---|---|
| 8,579,387 | B2 * | 11/2013 | Zhang | B25J 21/02 312/1 |
| 2002/0117158 | A1 * | 8/2002 | Burgess | 123/572 |
| 2007/0102887 | A1 * | 5/2007 | Sandford | F02F 11/002 277/598 |
| 2008/0083398 | A1 * | 4/2008 | Reichardt | F01M 13/0416 123/572 |
| 2010/0037844 | A1 * | 2/2010 | Kinsey et al. | 123/90.39 |

* cited by examiner

ENGINE ASSEMBLY WITH PASSAGEWAY FOR REDUCING OIL LEAKAGE

TECHNICAL FIELD

The disclosed inventive concept relates generally to engine assembly with passageway for reducing oil leakage.

BACKGROUND

Engine often uses lubrication system such as engine oil to lubricate moving parts, so as to reduce corrosion and provide cooling to a number of components in the engine. However, the oil in the lubrication system may escape under certain instances such as upon perimeter seal failure. As a result of that oil may contaminate various parts and surfaces of the engine. Moreover, engine operation may be retarded, and in some special cases leaked oil may become fire hazard and therefore endanger the entire engine operation.

Certain methods exist in an effort to reduce oil leakage, however, have been met with limited use. For instance, U.S. Pat. No. 4,584,975 discloses an engine lubricating oil drain arrangement including an inclined drain trough. The structure disclosed there has certain limitation as to where the oil must first be present in order to be collected.

SUMMARY

In one aspect, the present invention provides an engine assembly, which includes at least one cylinder head including a first surface, and at least one camshaft cover including a second surface, the first and second surfaces together defining a passageway positioned next to a seal for reducing oil leakage.

The passageway may be defined by a recess on at least one of the first and second surfaces.

The engine assembly may further include one or more openings for leading away collected engine oil for exit at a predetermined position. The predetermined position may be located at a relatively low temperature area of the engine during operation. The one or more openings may include an opening directed toward the exterior and/or the interior of the engine assembly. The opening may be in communication with an oil sump of the engine. The opening may be connected to an oil outlet received within the oil of the oil sump.

The engine assembly may further include a second seal contacting at least a portion of a first outer edge of the first surface and at least a portion of a second outer edge of the second surface to surround the passageway.

The engine assembly may further include a check valve at the opening to reduce air flow into the camshaft cover.

The engine assembly may further include an oil leaking sensor.

In another aspect, the present invention provides a method of reducing oil leakage in an engine, the method including providing an engine assembly described herein elsewhere.

The above advantages and other advantages and features will be readily apparent from the following detailed description of embodiments when taken in connection with the accompanying drawings.

BRIEF DESCRIPTION OF THE DRAWINGS

For a more complete understanding of one or more embodiments of this invention, reference should now be made to the embodiments illustrated in greater detail in the accompanying drawings and described below by way of examples wherein.

DETAILED DESCRIPTION OF ONE OR MORE EMBODIMENTS

Figure 1A:
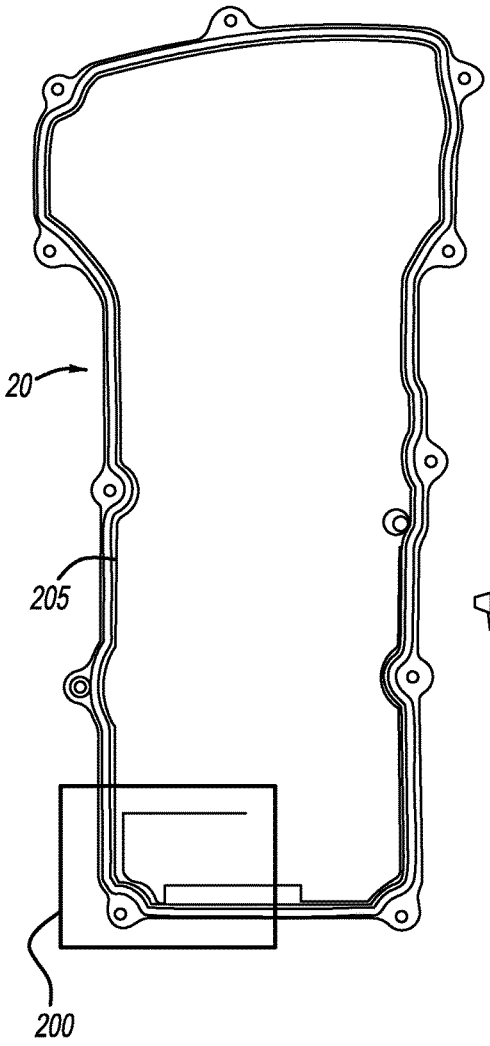
FIG. 1A illustratively depicts a camshaft cover of an engine assembly according to one or more embodiments.

As referenced in the FIGS., the same reference numerals are used to refer to the same components. In the following description, various operating parameters and components are described for different constructed embodiments. These specific parameters and components are included as examples and are not meant to be limiting.

The disclosed inventive concept is believed to have overcome one or more of the problems associated with certain known structure and method of reducing oil leakage.

Figure 4:
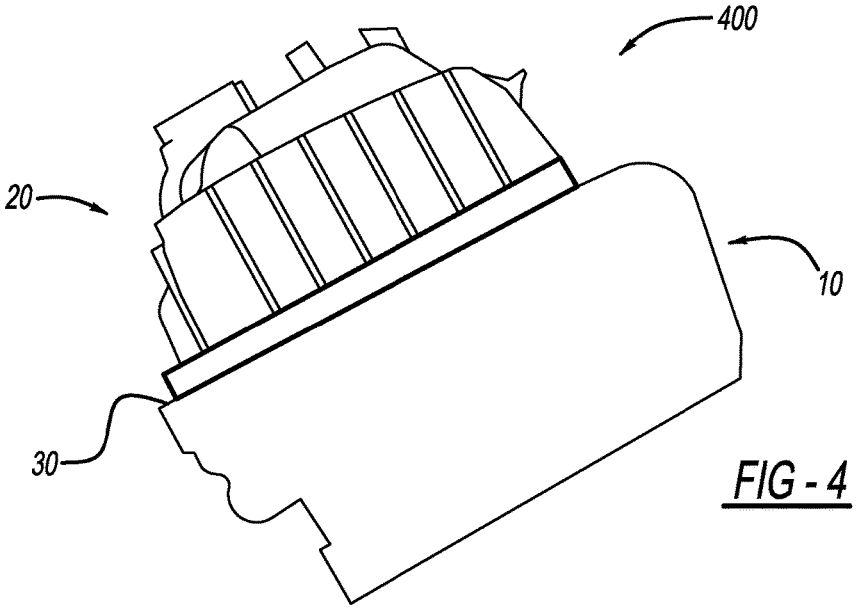
FIG. 4 illustratively depicts an alternative view of the engine assembly referenced in FIG. 3.

In one or more embodiments, and as illustratively depicted in FIG. 4, the present invention provides an engine assembly generally shown at 400. In further reference to FIG. 1A, FIG. 1B and FIG. 2, the engine assembly 400 includes a cylinder head 10 having a first surface 101, a camshaft cover 20 having a second surface 205, the first and second surfaces 101 together defining a passageway 203. Reference numeral 30 indicates an interface where the first surface 101 and the second surface 205 come to contact with each other. Referring back to FIG. 4 and in view of FIG. 1A and FIG. 1B, the camshaft cover 20 may be connected to the cylinder head 10 so as to provide a closed environment for camshaft components. As illustratively depicted in FIG. 1A, the camshaft cover 20 may include a seal 201 at least partially positioned between the camshaft cover 20 and the cylinder head 10 in an effort to reduce or prevent oil leakage. In certain embodiments, the seal 201 may be at least partially positioned between the surfaces 101, 205; and in certain particular embodiments, the seal 201 is provided to be present along the entire perimeter of the surfaces 101, 205. The seal 201 may be of any material or of any shape, with non-limiting examples thereof including rubber gasket and sealing strip.

Referring back to FIG. 1B the first surface 101 of the cylinder head 10 interfaces with the camshaft cover 20 via the latter's second surface 205.

Figure 1B:
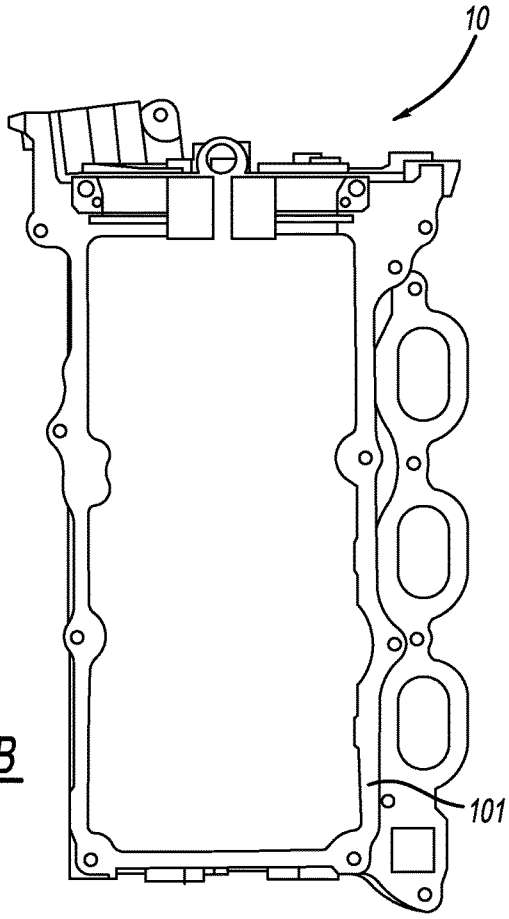
FIG. 1B illustratively depicts an engine cylinder head of the engine assembly referenced in FIG. 1A.
Figure 2:
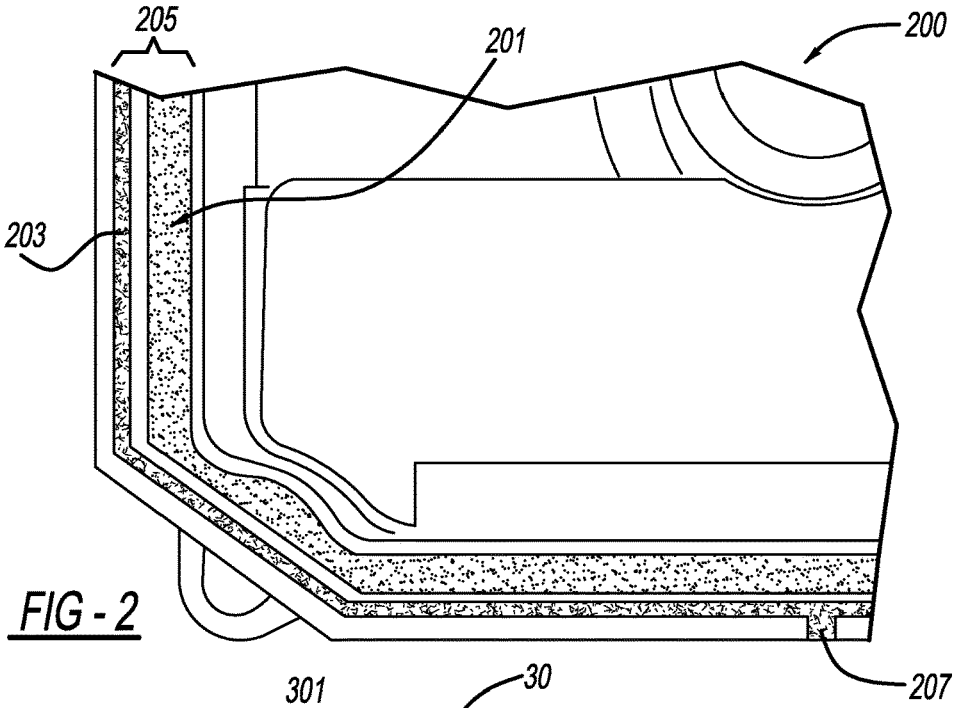
FIG. 2 illustratively depicts a passageway defined in the engine assembly referenced in FIG. 1A.

FIG. 2 illustratively depicts an enlarged view of portion 200 referenced in FIG. 1A. As mentioned herein elsewhere, the camshaft cover 20 is depicted to include the second surface 205 and the seal 201. In one or more embodiments, and as illustratively depicted in FIG. 2, the passageway 203 is positioned next to the seal 201. Any portions of the passageway 203 may be spaced apart from the seal 201 and may also be formed such that parts of the material forming the seal 201 may in effect become a wall forming the passageway 203. For reasons such as material aging or inappropriate installation, the seal 201 may become ineffective in keeping oil within the engine block compartment and hence unwanted oil leakage may occur. However now with the passageway 203 in place, any amounts of oil that would otherwise escape beyond the seal 201 may get collected via the passageway 203 for suitable downstream treatment as detailed herein elsewhere. Because any oil leakage is thus more reasonably confined rather than being free of control, oil contamination at areas external to the engine block compartment may be substantially prevented, and therefore various vehicle components outside of the engine block may be safeguarded against oil related damages also. The engine block compartment is often limited in the space that is available, and there are a number of important components near the areas outside of the engine block. In an event of uncontrolled oil leakage, the components outside of the engine block may be oil contaminated and the engine block may become unnecessarily compromised in its operational function. In certain particular embodiments, and when the leaked oil may come in contact with areas of relatively high temperature, and particularly areas where fire sparks or collisions are present, the presence of the leaked oil may lead to engine compartment fire. The passageway positioned next to the seal 201 thus provides a back-up measure for collecting the leaked oil and then leading it away from otherwise contaminating the engine surfaces and nearby components.

The passageway 203 may include one or more openings 207 for collecting and redirecting any leaked oil to one or more predetermined positions of the engine compartment of the vehicle, which are often a relatively less damage-sensitive area. In certain embodiments, the passageway 203 may be provided with a slope, wherein a first side of the passageway 203 which is relatively further away from the opening 207 is more elevated or higher along a direction of gravity than a second side of the passageway 203 which is closer the opening 207. Accordingly the presence of the slope may help facilitate any leaked oil to move toward the opening 207 for later collection and re-direction.

It is appreciated that the passageway 203 does not have to be entirely positioned on the second surface 205 or on the first surface 101. For instance, the passageway 203 may be positioned entirely on the first surface 101, entirely on the second surface 205, or positioned partly on the second surface 205 and partly on the first surface 101. The second surface 205 or the first surface 101 does not have to necessarily smooth or flat, and may be sloped, stepped, or waved, among others, as long as a passageway forms when the two surfaces connect.

The passageway 203 may be of any suitable cross-sectional dimensions. In certain embodiments, it may be practically beneficial for an average cross-sectional dimension not to be under certain threshold value so as to avoid unnecessary oil flow blockage. Similarly, the passageway 203 may not be too large in cross-sectional dimension, which may otherwise lead to unwantedly high oil flow rate and hence damages to the engine itself.

In a non-limiting example, a pressure differential within the camshaft cover 20 is 3 KPa, and any oil leakage may need to be controlled at no more than 2 quarts per minute. Further assume that the passageway 203 has a cross-sectional shape of a circle, the following calculation may apply:

The pressure differential may be calculated according to equation $P=\rho*U^2/2$, wherein the pressure differential is 3 KPa, and then the oil flow rate U is 2.9 m/s.

Flow Q may be calculated from $Q=u*A$, wherein u is flow rate and A is cross-sectional area. When Q is smaller than 2 quarts per minute, then the cross-sectional area A is no smaller than 11.4 $mm^2$.

When the cross-section is a circle, the diameter "d" is no smaller than 3.8 mm which is calculated by the equation $d=\sqrt{4A/\pi}$.

This method provides a non-limiting example of how the cross-sectional dimension of the passageway 203 may be determined based on a given pressure differential.

Figure 3:
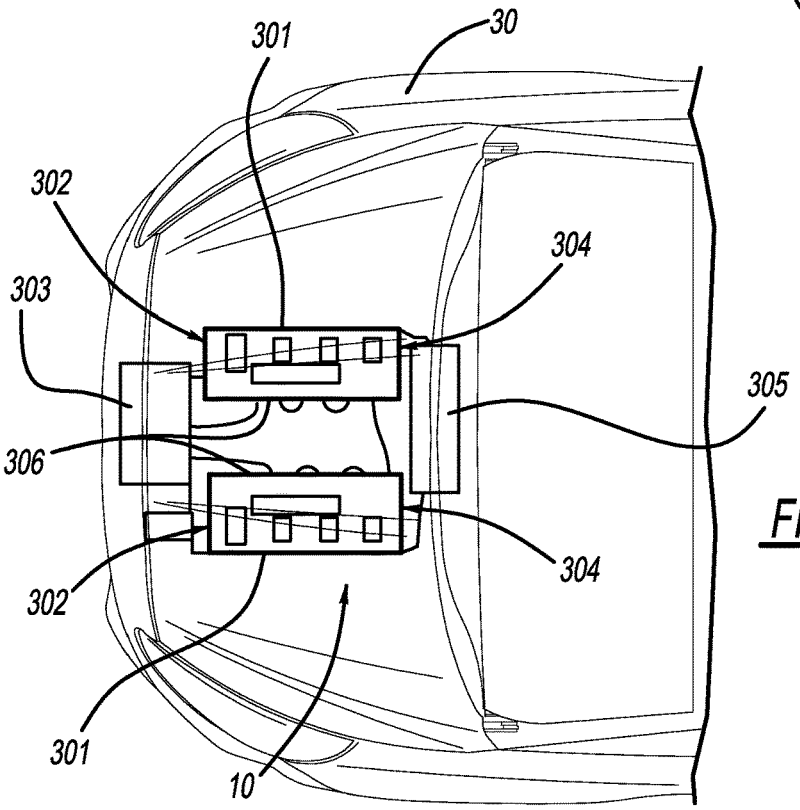
FIG. 3 illustratively depicts an opening defined in the passageway referenced in FIG. 2.

It is appreciated that the present invention is not limited to a particular type of an engine. Rather, the present invention may be used in any suitable engine, with non-limiting examples thereof including V-type engine, inline type engine, horizontal opposed, single-cylinder, front mounted engine and rear mounted engine In a V-type engine according to one or more embodiments, and further in view of FIG. 2, FIG. 3 and FIG. 4, the opening 207 may be positioned along the perimeter of the engine cylinder head 10 such as non-limiting locations indicated as 302, 304 and 306. The opening 207 may also be positioned at locations such as an anterior 303 or a posterior 305. These locations and areas are often provided with relatively lower operating temperatures, possibly due to the operation and effect of the cooling systems or absence of hot externally mounted components. Accordingly, the opening 207 is positioned at locations with relatively lower operating temperatures and any direct contact of the leaked oil is avoided with the relatively higher temperature areas such as exhaust emission areas shown at 301. With this arrangement, leaked oil may be lead away from the relatively more fire-sensitive areas such as areas 301 and thus fire hazard due to leaked oil coupled with high temperatures may be effectively reduced in occurrence.

In certain embodiments, the opening 207 may be in connection with a tube or other suitable extension component to lead the leaked oil further away from the engine area to reduce unnecessary oil contamination and the likelihood of oil-induced fire hazard.

In certain embodiments, the opening 207 may be directed toward an interior of the engine. Such an opening is represented by opening 507 depicted in FIG. 5. In certain particular embodiments, the opening 507 may be connected to an oil sump via a channel 509 positioned within the engine block. In the event of an oil leakage, the leaked oil may be collected at the opening 507 and get directed toward the oil sump via the channel 509. This design not only helps reduce oil contaminations due to oil leakage, but also helps recycle the otherwise good oil. This design is particularly beneficial in that the internal collection via the channel 509 may be controlled as need-based such that relatively fresher oil at its early operating life may be collected and relatively older oil at its aged operating life may be discarded rather than recycled. To reduce the possibility of any gas or air bubbles entering the oil sump via the opening 207 and/or via any internal channels of the engine block, the internal channel such as internal channel 509 be extended in length such that its tip portion is physically submerged underneath the oil surface of the oil sump.

Figure 5:
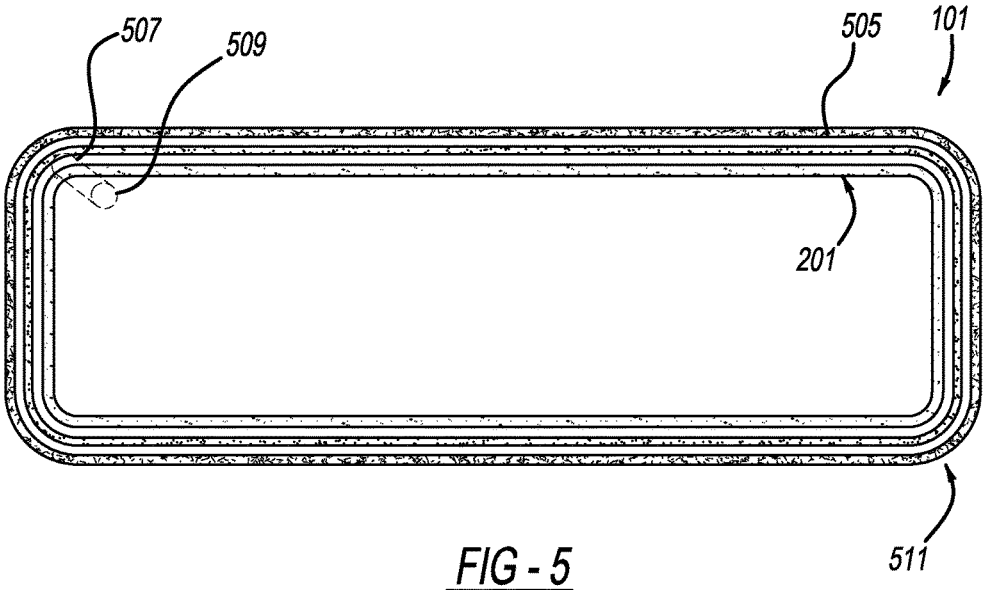
FIG. 5 illustratively depicts a top view of the passageway referenced in FIG. 2.

In certain embodiments, and to further reduce potential oil leakage, and as illustratively depicted in FIG. 5, a second seal 505 may be provided next to the passageway 203. The second seal 505 may be contacting at least a portion of the surface 205 and the surface 101.

Figure 6:
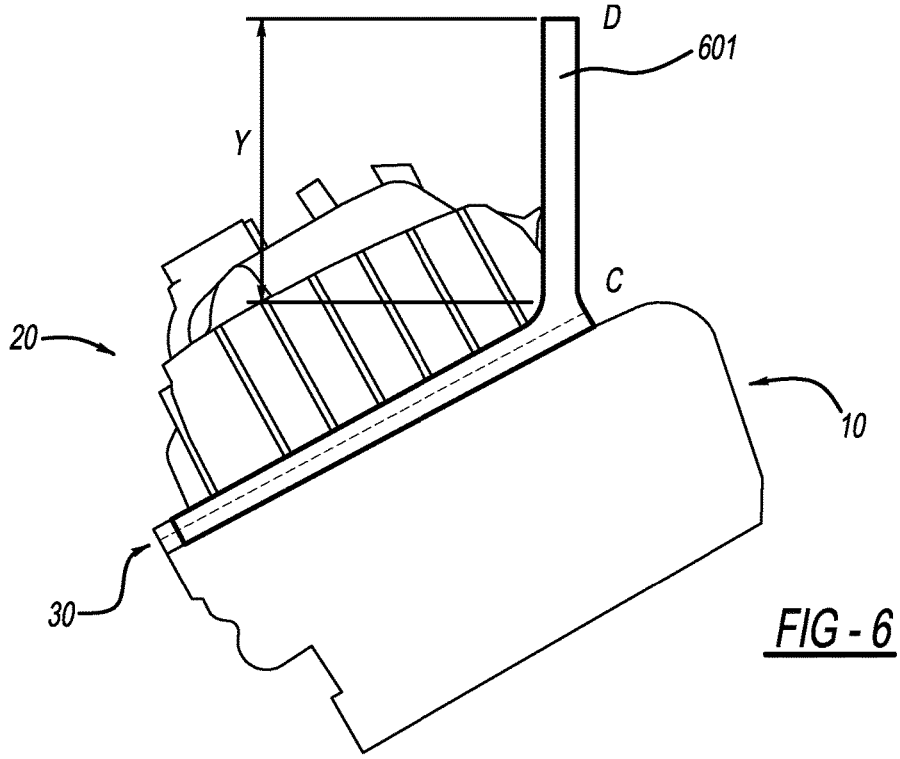
FIG. 6 illustratively depicts a perspective view of an alternative design of the engine assembly referenced in FIG. 1A.

In certain embodiments, and as illustratively depicted in FIG. 6, recycling of any leaked oil may be realized without necessarily having to connect the opening 207 with the engine oil sump. For instance, the opening 207 may be in direct connection with portion C of a storage container 601 for at least temporarily storing the leaked oil collected at the opening 207. In certain instances, and as illustratively depicted in FIG. 6, the storage container 601 is positioned against the direction of the gravity and for instance is positioned above the engine block. This may be beneficial because the force of gravity reduces the opportunity of the leaking oil to escape to the exterior. When the force of the internal oil pressure exceeds the force of gravity, will the oil leak to the exterior and the storage container 601 helps collected that leaked oil. When the region underneath the camshaft cover 20 is in a vacuum or at a relatively low pressure, a pressure difference present underneath the camshaft cover 20 may work to retrieve the leaked oil otherwise stored in the storage container. Often the pressure may not be controllable as possibly a result of the engine operating conditions. Therefore the employment of the storage container 601 is particularly beneficial to capture any leaked oil under these unforeseeable situations. With the oil density and the pressure differential between inside and outside the camshaft cover 20, the storage container 601 is provided with a suitable height Y so as to reduce oil spill from the external storage container. When the oil density is for instance 800 kg/m$^3$ and the pressure differential between inside and outside of the camshaft cover 20 is for instance 3 KPa, the height Y of the external collection container is about no smaller than 382 millimeters (mm). The external collection container may be integral to the cylinder head 10, both in material continuity and manufacturing processes.

Figure 7:
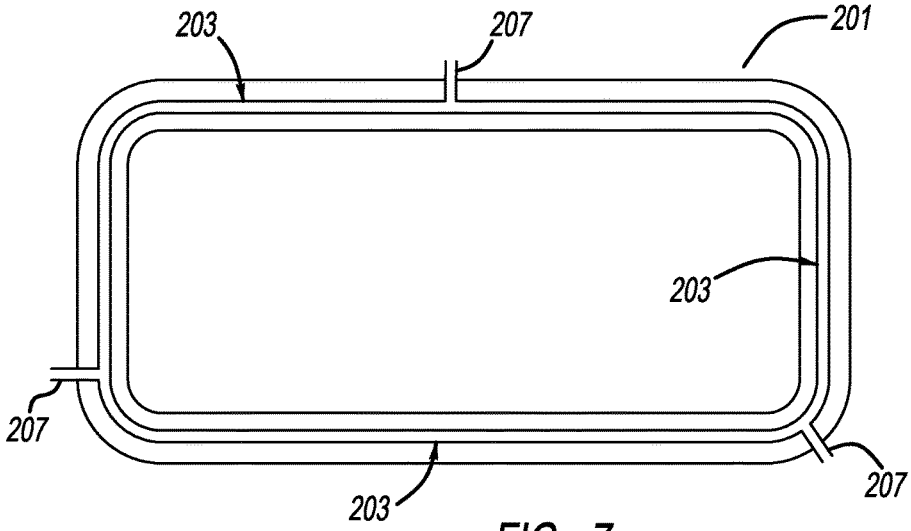
FIG. 7 illustratively depicts an alternative view of the passageway referenced in FIG. 5.

In certain embodiments, and as illustratively depicted in FIG. 7, the passageway 203 does not necessarily have to be all-around structure circulating the seal 201, and in fact may be discontinuous by including two or more spaced apart segments. This design of having two or more spaced apart segments may be particularly beneficial in situations where another component may be mounted at the sealing surfaces such as at location 511 illustratively depicted in FIG. 5. In these embodiments, each of the segments may be provided with one or more openings such as opening 207. As mentioned herein elsewhere, one or more passageways 203 positioned next to the seal 201 help collect and redirect leaked oil at any suitable position along the perimeter of the first and second surfaces 101, 205, and help lead the collected oil to locations that are relatively less susceptible to oil damages or fire hazards.

In one or more embodiments, and to prevent as much as possible air return back to the camshaft cover 20 via the opening 207, one or more check valves such as duckbill check valves may be positioned at the opening 207.

In certain embodiments, one or more oil sensors may be positioned at or near the opening 207, 507 to alert for a possible oil leakage event. Certain existing oil sensors are often designed to detect for a measurable change in oil content level. In these instances, oil leakage and downstream oil contamination may have already happened in a substantial way prior to the sensors sending out any warning. The present invention in one or more embodiment is therefore advantageous in providing a mechanism for early detection of oil leakage right where any oil leakage first takes place, such that enhanced level of driving safety may be provided to the driver and the occupant.

In one or more embodiments, the disclosed invention as set forth herein overcomes the challenges faced by known production of handles for accessing various liquid storage containers in an engine compartment. However, one skilled in the art will readily recognize from such discussion, and from the accompanying drawings and claims that various changes, modifications and variations can be made therein without departing from the true spirit and fair scope of the invention as defined by the following claims.

What is claimed is:

1. An engine assembly comprising:

at least one cylinder head including a first surface; and at least one camshaft cover including a second surface, the first and second surfaces together defining an oil drain passageway positioned next to a first seal for reducing oil leakage, the oil drain passageway being at least partially positioned on an interface contacting both the first and second surfaces.

2. The engine assembly of claim 1, wherein the oil drain passageway is a recess on at least one of the first and second surfaces.

3. The engine assembly of claim 1, wherein the oil drain passageway includes an oil drain opening directed toward an interior of the engine assembly.

4. The engine assembly of claim 1, wherein the oil drain passageway includes a first oil drain opening directed toward an exterior of the engine assembly and a second oil drain opening directed toward an interior of the engine assembly.

5. The engine assembly of claim 1, further comprising a second seal contacting at least a portion of the first surface and at least a portion of the second surface, the oil drain passageway being positioned between the first and second seals.

6. A method of reducing oil leakage in an engine, the method comprising:

providing an engine assembly which includes a cylinder head having a first surface, and a camshaft cover having a second surface, the first and second surfaces together defining an oil drain passageway positioned next to a seal for reducing oil leakage, the oil drain passageway being at least partially positioned on an interface contacting both the first and second surfaces.

7. The method of claim 6, wherein the oil drain passageway is a recess on at least one of the first and second surfaces.

8. The method of claim 6, further comprising providing one or more oil drain openings at the oil drain passageway for leading away collected engine oil for exit at a relatively low temperature area of the engine during operation.

9. The method of claim 6, further comprising providing the oil drain passageway with one or more oil drain openings directed toward an interior of the engine assembly.

10. An engine assembly comprising:

a cylinder head including a first surface;

a camshaft cover including a second surface; and a first seal at least partially positioned between the first and second surfaces, wherein the first and second surfaces together define an oil drain passageway positioned next to the first seal, the oil drain passageway being at least partially positioned on an interface contacting both the first and second surfaces, and the oil drain passageway defines an oil drain opening for leading away leaking engine oil for exit at a predetermined position, and wherein the first seal is positioned between the oil drain passageway and an interior of the engine assembly; and a second seal containing at least a portion of the first surface and at least a portion of the second surface, the oil drain passageway being positioned between the first and second seals.

11. The engine assembly of claim 1, wherein the oil drain passageway includes a first recess on the first surface and a second recess on the second surface.

12. The engine assembly of claim 1, wherein the first seal is positioned between the oil drain passageway and an interior of the engine assembly.

13. The engine assembly of claim 5, wherein the second seal contacts at least one of the first and second surfaces.

14. The engine assembly of claim 1, further comprising a storage container supported on the cylinder head and positioned against a direction of gravity to collect oil from the oil drain passageway.

15. The engine assembly of claim 14, wherein the storage container is integral to the cylinder head.

16. The engine assembly of claim 10, further comprising a storage container supported on the cylinder head and positioned against a direction of gravity to collect oil from the oil drain passageway.

17. The engine assembly of claim 16, wherein the storage container is integral to the cylinder head.

18. The engine assembly of claim 10, wherein the oil drain passageway is structurally located along a circumference of at least one of the first and second surfaces.

19. The engine assembly of claim 1, wherein the oil drain passageway is structurally located along a circumference of at least one of the first and second surfaces.

20. The engine assembly of claim 6, wherein the oil drain passageway is structurally located along a circumference of at least one of the first and second surfaces.

* * * * *